US008276303B2

(12) United States Patent
Kapusta et al.

(10) Patent No.: US 8,276,303 B2
(45) Date of Patent: Oct. 2, 2012

(54) FIREARM HAND GUARD RAIL SYSTEM

(75) Inventors: John Kapusta, Novi, MI (US); Tai-Lai Ding, Northville, MI (US)

(73) Assignee: Smith & Wesson Corp., Springfield, MA (US)

( * ) Notice: Subject to any disclaimer, the term of this patent is extended or adjusted under 35 U.S.C. 154(b) by 277 days.

(21) Appl. No.: 12/769,317

(22) Filed: Apr. 28, 2010

(65) Prior Publication Data

US 2011/0061281 A1 Mar. 17, 2011

Related U.S. Application Data

(60) Provisional application No. 61/174,233, filed on Apr. 30, 2009.

(51) Int. Cl.
*F41C 23/16* (2006.01)

(52) U.S. Cl. ..... 42/71.01

(58) Field of Classification Search ..... 42/71.01, 42/72, 73, 75.03, 90
See application file for complete search history.

(56) References Cited

U.S. PATENT DOCUMENTS

2007/0017139 A1* 1/2007 Larue ..... 42/75.1
2010/0319231 A1* 12/2010 Stone et al. ..... 42/71.01
2011/0016762 A1* 1/2011 Davies ..... 42/75.01
2011/0239513 A1* 10/2011 Sandman ..... 42/90

OTHER PUBLICATIONS http://www.milsurpstuff.com.
Seven (7) photographs of UTG HG416 SF Rail System.

* cited by examiner

*Primary Examiner* — Gabriel Klein
(74) *Attorney, Agent, or Firm* — Ballard Spahr LLP

(57) ABSTRACT

A hand guard rail system is fastened to a firearm having a barrel and a barrel nut, with the hand guard rail aligned to the top rail of the firearm. The hand guard rail system includes a hand guard and a sleeve fitted into the hand guard. The sleeve and the hand guard are fastened to the barrel nut, thereby aligning the hand guard to the firearm.

17 Claims, 7 Drawing Sheets

FIREARM HAND GUARD RAIL SYSTEM

CROSS REFERENCE TO RELATED APPLICATIONS

This application claims the benefit of U.S. Provisional Application Ser. No. 61/174,233, filed on Apr. 30, 2009, which is herein incorporated by reference in its entirety.

FIELD OF THE INVENTION

The present invention relates generally to a firearm hand guard rail system and more particularly to a hand guard rail system that facilitates the attachment and alignment of accessories on a rifle while providing an ease of manufacture.

BACKGROUND OF THE INVENTION

To promote the flexible use of a firearm, it is often desirable to attach and secure accessories to the firearm. In particular, with tactical rifles, such as the M-16, or its civilian counterpart the AR-15, it is generally desirable to attach flashlights, sights, lasers, scopes, scope rings and the like. Most accessories are attached via a rail system employing what is referred to as the M1913 Picatinny standard, i.e., a Picatinny rail. Typically, the point of attachment for such a rail is either the upper receiver of the firearm or the hand guard which surrounds the barrel and protects the hands of a shooter from heat.

Many known rail systems include an accessory rail that is integral with a hand guard. Such hand guards are either secured to both the barrel nut and the top of a firearm receiver or are attached only to the nut. As discussed below, however, these known systems have potential drawbacks.

Several known designs involve the radial attachment of a hand guard rail system to a conventional barrel nut through a clamp or a yoke while floating about, i.e., not touching, the barrel. An example of such a design is shown in a patent to Troy, U.S. Pat. No. 7,216,451. In general, these designs permit the hand guard to twist or move laterally relative to the receiver when the guard is jarred or bumped. This potential for movement is due to the large moment arm created by the extension of the relatively long hand guard from the barrel nut, in combination with the flexibility of, and motion between, the intermediate pieces connecting the hand guard to the receiver. Such movement is potentially problematic if, for example, sights or scopes are mounted to the rail.

Other somewhat similar designs allow a hand guard rail system to be attached to a barrel nut through the use of setscrews. For example, a patent to Booth, U.S. Pat. No. 6,671,990, discloses a hand guard including an adaptor ring, which is slipped over a barrel nut and secured via a series of setscrews. Setscrew arrangements, like clamp or yoke arrangements, potentially permit movement of a hand guard relative to a receiver upon jarring.

A more recent design is disclosed in a published patent application by Daniel, et al., US 2008/0092422, which is directed to a hand guard and accessory mounting device for a firearm. This design includes an adaptor that mounts between the barrel nut and a portion of the firearm, as opposed to the hand guard being clamped directly onto the barrel nut. A problem with this design is that it is difficult to precisely align the top rail surface of the hand guard with the top of the firearm upper receiver so that they are in registration. Indeed, alignment is accomplished through trial and error by placing the adaptor in an estimated aligned position, securing the adaptor via the barrel nut, and then assembling the rail/hand guard to the firearm to assess alignment. Threading the barrel nut onto the receiver to secure the adaptor can cause rotation of the adaptor from its aligned position, which rotation could be detectable only by assembling the rail/hand guard to check alignment. If misaligned, the rail/hand guard must be disassembled and realigned. Moreover, the hand guard in US 2008/0092422 is relatively expensive to manufacture. This cost is due in large part to the number and variety of CNC machining setups required to cut internal and external surface features of the guard.

Another recent class of designs is typified by a published patent application by LaRue, US 2007/0017139, which discloses a hand guard/barrel nut clamping assembly for a tactical firearm. The assembly includes a barrel nut that is received within an annular hand guard retainer nut. Additionally, an anti-rotation clamp plate is employed to prevent the nuts from rotating relative to one another. Not only do additional components render such designs relatively expensive to manufacture, but also, the barrel nut is difficult to access for attaching or removing a barrel to or from the firearm. Moreover, while the anti-rotation clamp may prevent gross rotational movement of the nuts/hand guard after assembly, it still allows for rotation of the nuts during assembly and also allows for a small degree of rotation between the hand guard and the upper receiver after assembly.

As exemplified by the Daniel and LaRue designs, a problem with known hand guard rail systems is that the hand guards are manufactured from a substantial amount of material and have a fairly complex geometry. In particular, the rail portions of the guards are quite thick and the geometry of the guard surfaces requires extensive CNC machining. As will be appreciated, it is desirable to manufacture a hand guard rail system that is of a lighter weight and requires minimal CNC machining while maintaining sufficient strength and rigidity.

With the foregoing concerns in mind, it is the general object of the present invention to provide a hand guard rail system that is easily aligned and is resistant to rotational movement relative to a firearm receiver. Moreover, it is an object of the present invention to provide a strong, lightweight hand guard rail system that may be easily and inexpensively manufactured and assembled.

SUMMARY OF THE INVENTION

It is an object of the present invention to provide a firearm hand guard rail system.

It is an additional object of the present invention to provide a firearm hand guard rail system that includes an accessory rail.

It is yet another object of the present invention to provide a firearm hand guard rail system with an accessory rail that may be easily aligned with a firearm receiver.

It is another object of the present invention to provide a firearm hand guard rail system in which the accessory rail is resistant to rotational movement relative to a firearm receiver.

It is an additional object of the present invention to provide a firearm hand guard rail system in which the accessory rail may be manufactured more easily and at lesser cost than are known hand guard rail systems.

It is yet another object of the present invention to provide a firearm hand guard rail system that is stronger and is of lesser weight than are known hand guard rail systems.

According to some embodiments of the present invention, a firearm comprises a receiver with a barrel opening formed at a forward end of the receiver; a barrel inserted into the barrel opening; a threaded surface adjacent to the barrel opening; a barrel nut with a substantially cylindrical outer surface, a threaded portion coaxial with the outer surface, and smooth bores extending axially through the barrel nut at radial positions between the outer surface and the threaded portion, the threaded portion being threadedly engaged with the threaded surface such that the barrel nut secures the barrel into the barrel opening of the receiver; a hand guard with a substantially uniform cross-section extending from a forward end to a rearward end, the cross-section defined by a peripheral surface with protruding rails and an inward surface at least partly conforming to the peripheral surface, the hand guard also including bores formed in the rearward end for receiving threaded fasteners; a sleeve with an inner surface substantially complementary to the outer surface of the barrel nut, an outward surface substantially complementary to the inward surface of the hand guard, a first plurality of openings for receiving threaded fasteners inserted through the smooth bores of the barrel nut, and a second plurality of openings for receiving fasteners inserted in the bores of the hand guard, the sleeve being interposed between the barrel nut and the hand guard with the inner surface fitted over the barrel nut and the outward surface fitted into the hand guard; a first plurality of threaded fasteners inserted through selected smooth bores of the barrel nut into corresponding openings of the sleeve; and a second plurality of fasteners inserted in selected bores of the hand guard and corresponding openings of the sleeve.

In some embodiments, the second plurality of fasteners are threaded fasteners, and the bores of the hand guard are threaded. In other embodiments, the second plurality of fasteners are pins or smooth dowels. In some embodiments, the second plurality of openings include some openings arrayed in symmetric fashion, while other openings are disposed at pre-determined asymmetric locations.

These and other features, aspects and advantages of the present invention will be better understood in view of the following drawings and detailed description.

DETAILED DESCRIPTION OF THE DRAWINGS

Figure 1:
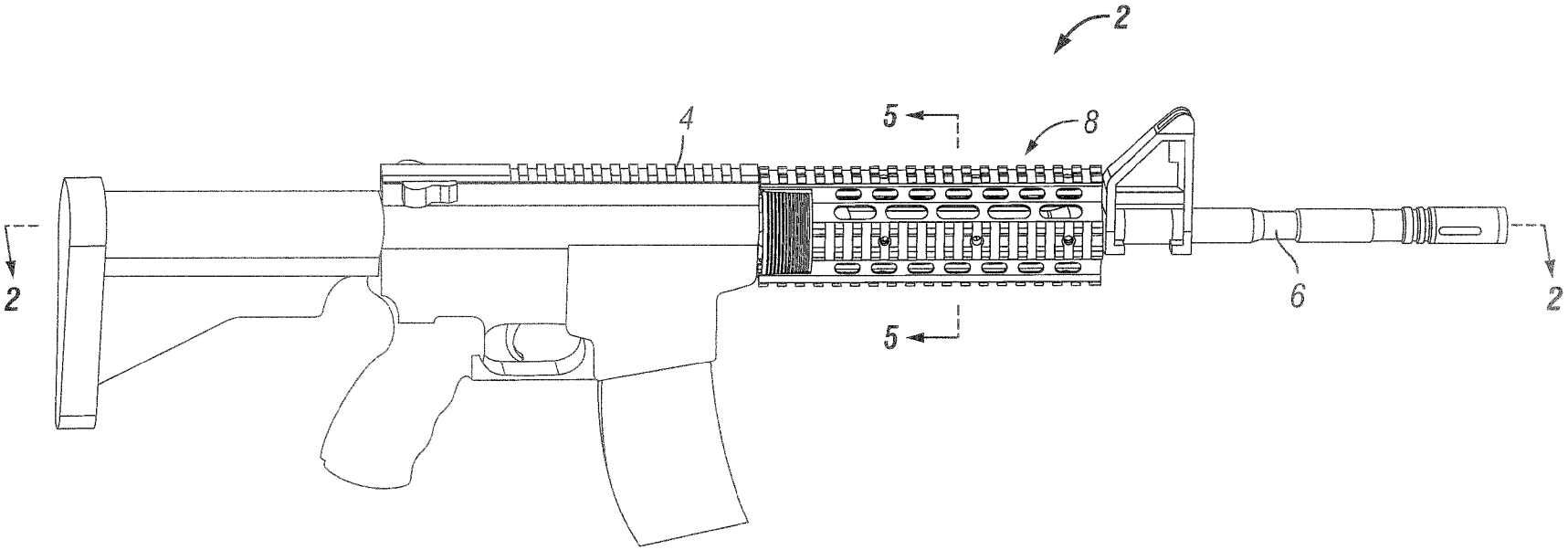
FIG. 1 shows a perspective view of a rifle including a firearm hand guard rail system, according to a first embodiment of the present invention.
Figure 2:
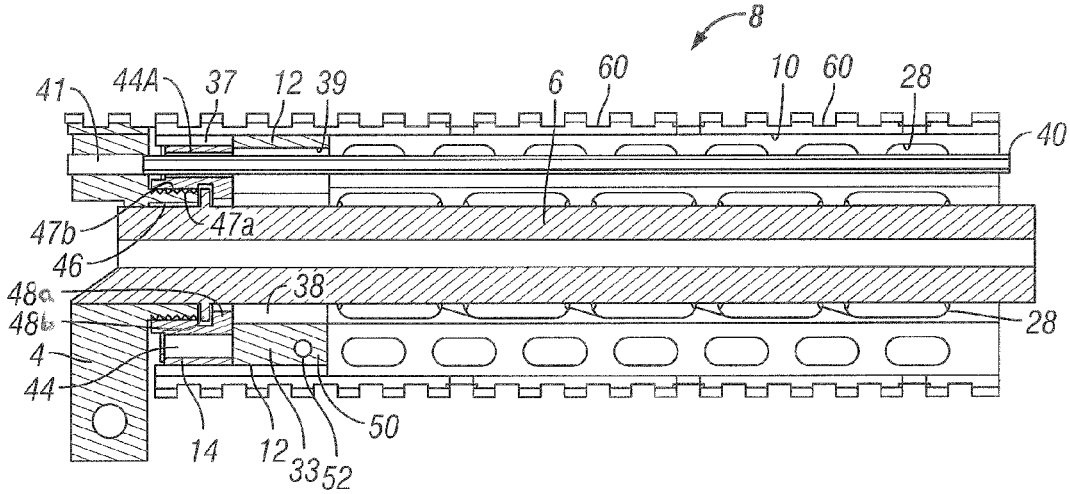
FIG. 2 shows a partial side view of the firearm and hand guard system, sectioned at the plane 2-2 shown in FIG. 1.

FIGS. 1 and 2 depict a firearm 2, including a receiver 4, a barrel 6, and a hand guard rail system 8 in accordance with an embodiment of the present invention. As an initial matter, the hand guard rail system is "free-floating" in that it does not contact the barrel of the firearm to which it is mounted. Further, the system is not secured to the top of a firearm receiver as conventionally known, but is secured at the barrel/receiver junction.

Figure 3:
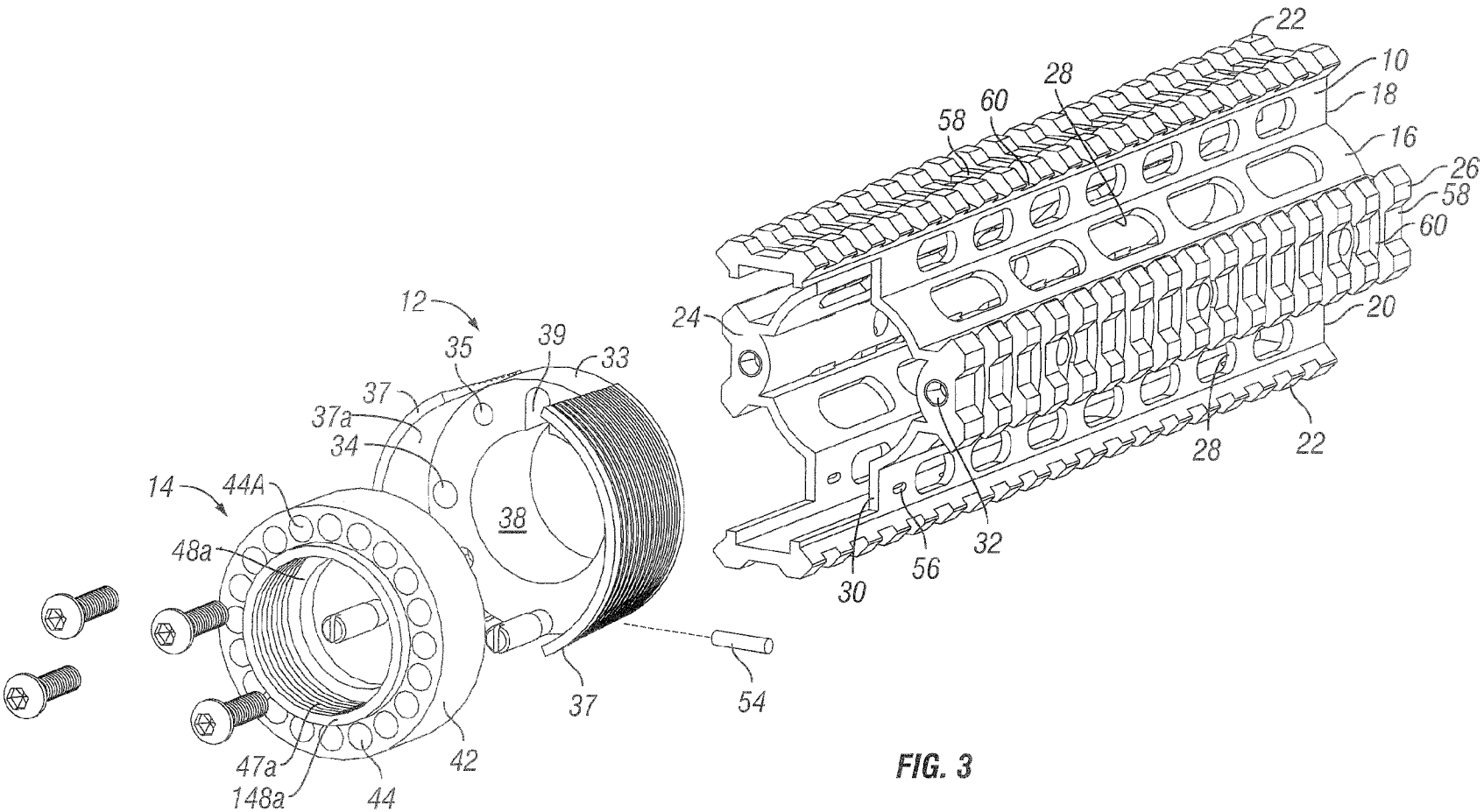
FIG. 3 shows an exploded rear perspective view of the hand guard rail system shown in FIG. 1.
Figure 4:
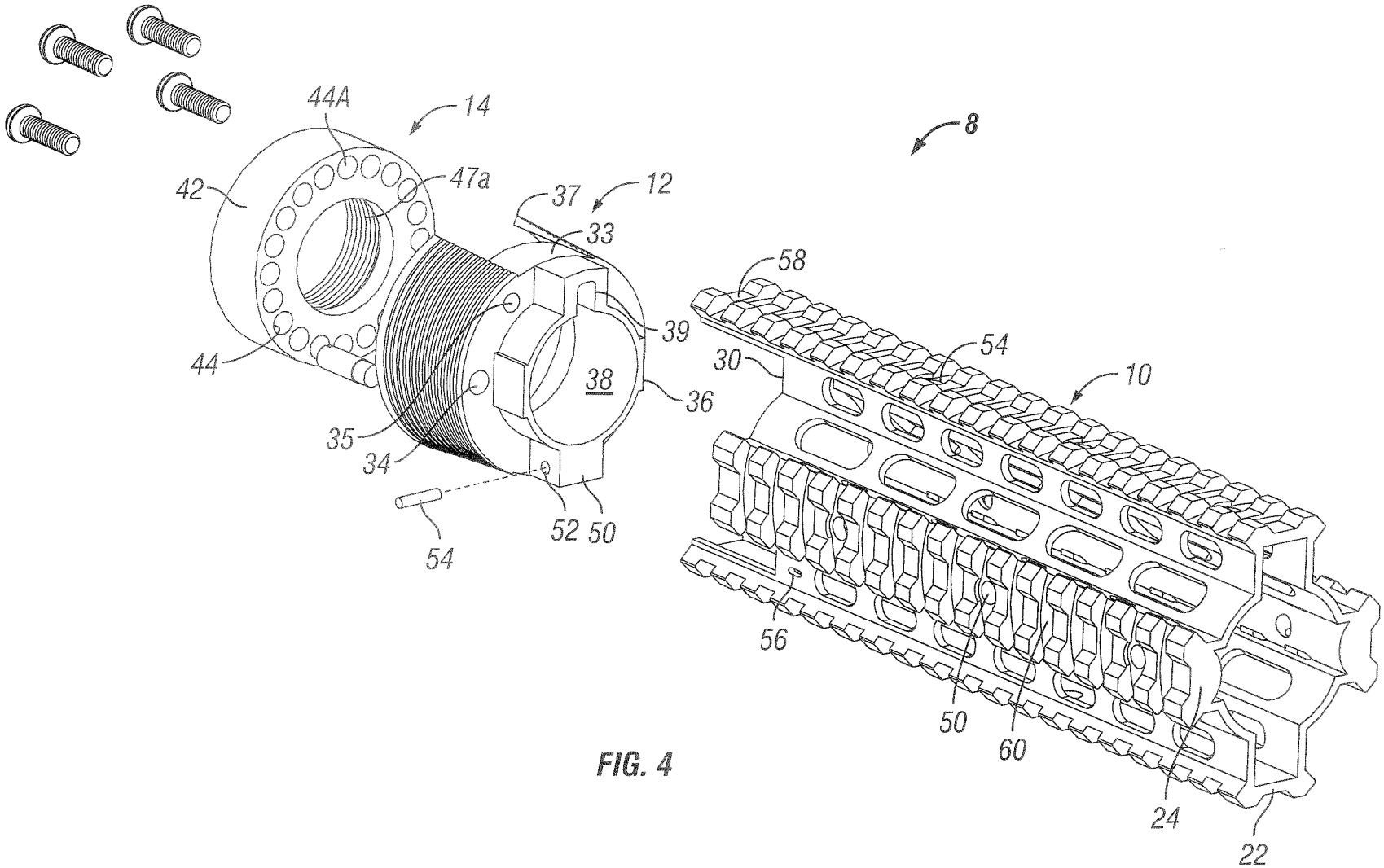
FIG. 4 shows an exploded front perspective view of the hand guard rail system shown in FIG. 1.

Referring to FIGS. 2 through 4, the hand guard rail system 8 includes a hand guard 10, a sleeve 12, and a barrel nut 14 for securing the barrel 6 and the hand guard 10 to the receiver 4.

Figure 5:
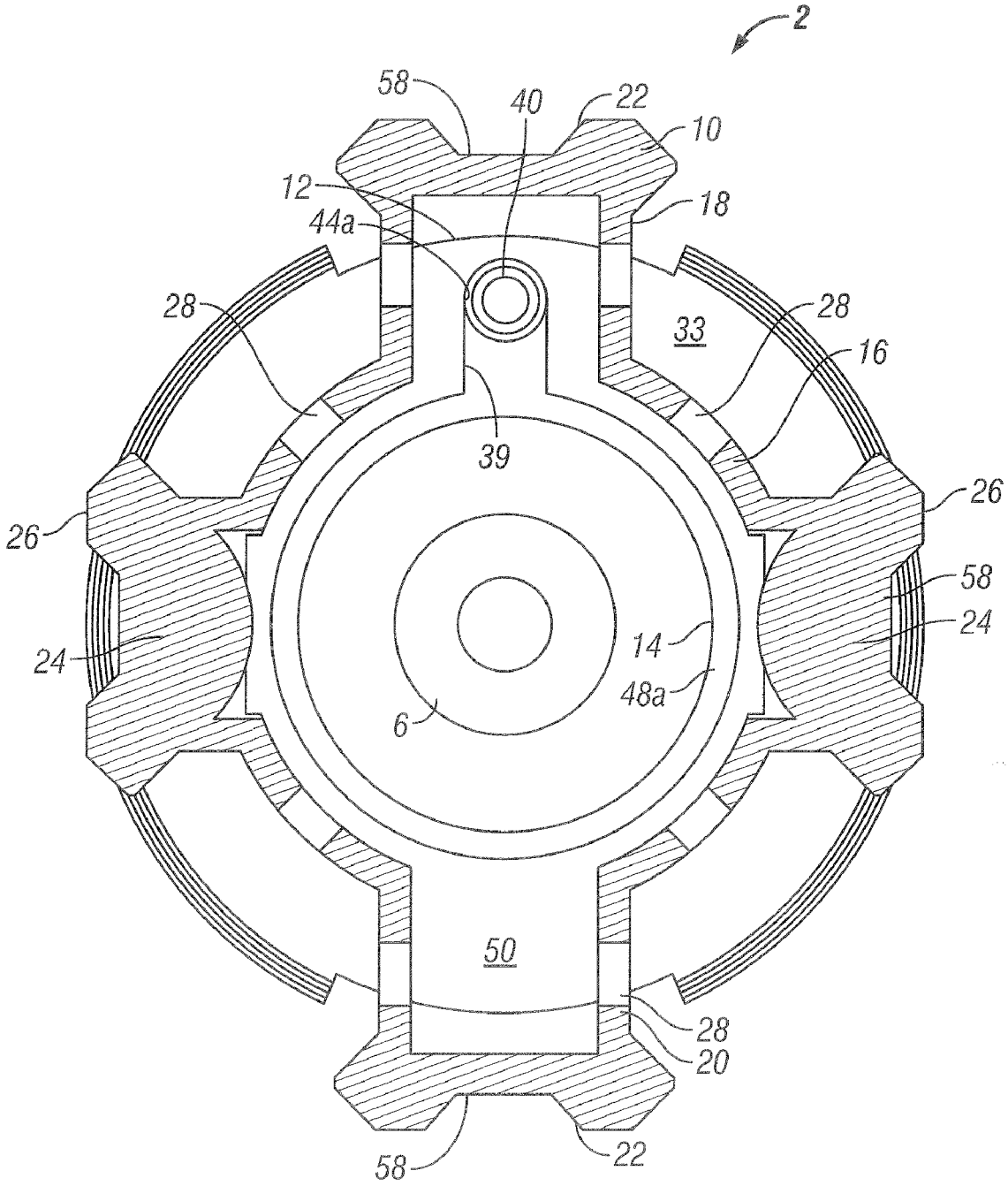
FIG. 5 shows an axial view of the hand guard shown in FIG. 1, sectioned at the plane 5-5 indicated in FIG. 1, further illustrating the interior and exterior geometry of the guard.

Referring to FIG. 5, the hand guard 10 has a generally annular body 16, which extends between opposing top and bottom channels 18 and 20 with top and bottom rails 22 formed on peripheral surfaces thereof. Between the top and bottom channels, the hand guard body is thickened to form laterally opposing sidewalls 24 with side rails 26 formed on peripheral surfaces of the sidewalls. Between the top and bottom channels and the sidewalls, the body is perforated with cooling holes 28. Additional cooling holes are formed along the sides of the top and bottom channels. The inward surfaces of the top and bottom channels and of the sidewalls define a barrel space for receiving the barrel 6.

Turning back to FIGS. 3 and 4, for assembly of the hand guard rail system 8, the thickened sidewalls 24, as well as inward portions of the top and bottom channels 18, 20, are cut away from a receiver end of the hand guard 10 to form a recessed portion 30 for receiving the sleeve 12. At the recessed portion of the hand guard, the exposed end surfaces of the sidewalls include threaded bores 32 for receiving threaded fasteners.

The sleeve 12 includes a main part 33, which is penetrated by cylindrical openings 34 for passage of threaded fasteners to be inserted into the threaded bores of the hand guard, and by threaded apertures 35 for receiving additional threaded fasteners. The sleeve also includes a forward part 36, which has an outward surface substantially conforming to the inward surface of the hand guard, and rearward wings 37, which define an inner surface 37*a* for receiving the barrel nut 14. The sleeve 12 encloses a central passage 38 for clearance around the barrel 6, and includes a curved interior surface or notch 39 that extends outward from the central passage for accommodating a gas tube 40 protruding forward from a gas port 41 of the receiver 4, as better shown in FIGS. 2 and 5.

Referring back to FIGS. 3 and 4, the barrel nut 14 has an outer surface 42 matching the inner surface 37*a* defined by the rearward wings 37 of the sleeve 12, and circumferentially-spaced smooth bores 44 for passage of threaded fasteners to be inserted into the openings 34 and threaded apertures 35 of the sleeve. Thus, the sleeve can be secured into the hand guard, and the barrel nut can be secured into the sleeve, by means of threaded fasteners, e.g., bolts, which are inserted through the bores of the barrel nut and threaded into the threaded bores of the sidewalls or the threaded apertures of the sleeve.

The threaded bores 32, the cylindrical openings 34, the threaded apertures 35, the notch 39, and the smooth bores 44 enable the hand guard 10, and its rail surfaces, to be quickly and easily aligned with the upper receiver of a firearm during assembly of the hand guard rail system 8. More specifically, during assembly, the barrel nut 14 is threadedly connected to the receiver 4 for securing the barrel 6 into a barrel opening 46 formed in the receiver. For example, an internally-threaded surface 47*a* formed on the barrel nut is threaded onto an externally-threaded boss 47*b* surrounding the barrel opening, as shown in FIG. 2, so that an inward lip 48*a* formed on the barrel nut clamps a flange 48*b* formed on the barrel against the boss of the receiver. As another option (not shown), a barrel nut with an externally-threaded surface may be threaded into an internally-threaded barrel opening. The gas tube 40 then is connected from the barrel through a selected bore 44A of the barrel nut and into the gas port 41 of the receiver, which is disposed at a "12 o'clock" position relative to the barrel opening. The gas tube may be threaded into the gas port, or may be press fit. Other arrangements will be apparent from those disclosed herein.

Figure 6:
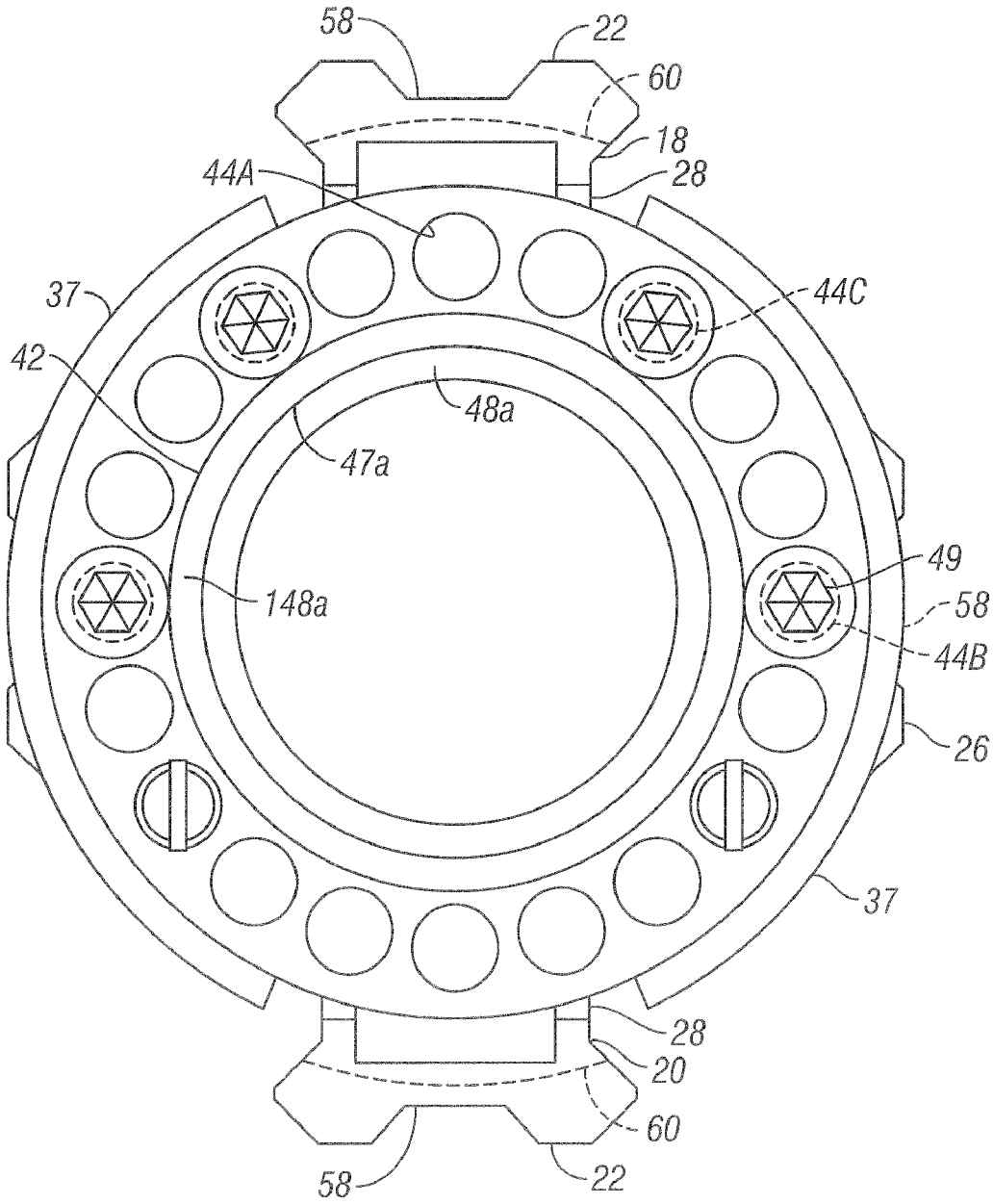
FIG. 6 shows a rear end view of the hand guard rail system shown in FIG. 1.

Referring to FIGS. 5 and 6, to permit connection of the gas tube 40 into the gas port 41, the bore 44A is necessarily aligned at the 12 o'clock position and is circumferentially in registry with the top rail of the receiver 4. Thus, the entire hand guard rail system 8 can be aligned with the receiver simply by slipping the notch 39 and the top channel 18 over the gas tube in order to assemble the sleeve 12 and the hand guard 10 over the barrel nut and the barrel 6. The angular spacings of the smooth bores 44, the apertures 36, the cylindrical openings 34, and the threaded bores 32 are chosen to facilitate this simple process.

Figure 7:
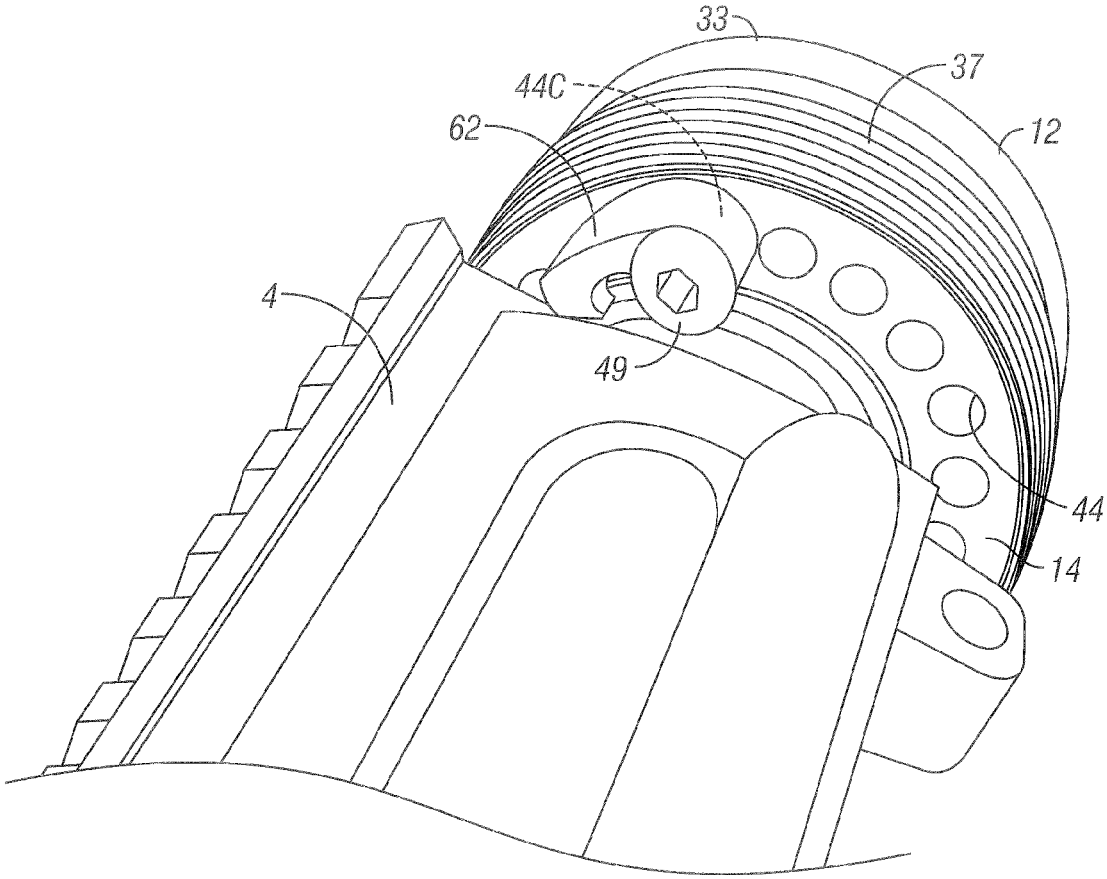
FIG. 7 shows an enlarged perspective partial view of a firearm receiver and a barrel nut of the hand guard rail system shown in FIG. 1, depicting the use of contact fingers to prevent rotational movement.
Figure 8:
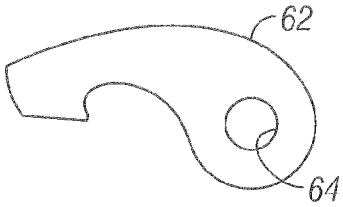
FIG. 8 shows a detail view of a contact finger for use according to FIG. 7.

In a preferred configuration, as best shown in FIGS. 6 and 7, allen bolts 49 are used to secure the sleeve 12 to the guard 10. These bolts pass through selected smooth bores 44B of the barrel nut 14, through the cylindrical openings 34 in the sleeve, and into the threaded bores 32 in the guard sidewalls 24. A combination of allen bolts and pins are then employed to further secure the barrel nut 14 to the sleeve 12 via other smooth bores 44C, threaded apertures 35, and cylindrical openings 34. As will be readily apparent, other combinations or types of fasteners may be employed as long as a secure connection is established between the nut 14, sleeve 12 and guard 10.

For additional ease of assembly, as best shown in FIGS. 2 and 4, the forward part 36 of the sleeve 12 also includes a forwardly protruding lower lug 50. The lug has a transverse bore 52 that receives a pin 54. The lug allows the sleeve to be pinned into the hand guard 10. More specifically, when the sleeve 12 is fitted into the recessed end portion 30 of the receiver end of the hand guard, the lug slides into the bottom channel 20 and the bore of the lug aligns with lateral holes 56 formed through the sides of the bottom channel. The pin may then be placed through the lateral holes and through the bore of the lug to secure the sleeve into the hand guard.

The ability to pin the sleeve 12 to the hand guard 10 via the lug 50 allows the hand guard rail system 8 to be partially assembled, i.e., the sleeve can be attached to the guard prior to assembly with the barrel nut 14. The lug also provides an additional point for attachment of a firearm receiver to the hand guard, via the sleeve and the barrel nut. The additional attachment point strengthens the connection between the receiver and guard and provides an additional barrier to rotational movement of the hand guard relative to the receiver upon accidental jarring or bumping of the firearm during use.

Thus, the hand guard rail system 8 can be rapidly and reliably assembled in alignment with the firearm 2 by a process of few steps. First, threading the barrel nut 14 onto the receiver 4 to secure the barrel with a "12 o'clock" bore 44A of the barrel nut aligned to the gas port of the firearm, while separately, pinning the sleeve 12 into the hand guard 10 with the top channel 18 aligned to the notch 39. Second, connecting the gas tube 40 from the barrel through the 12 o'clock bore of the barrel nut to the receiver gas port 42. Third, assembling the sleeve and hand guard to the barrel nut, over the barrel and the gas tube, with the notch of the sleeve and the top channel of the hand guard aligned to the gas tube. By using the gas tube to locate the sleeve and the hand guard, smooth bores 44B of the barrel nut will self-align with the cylindrical openings 34 of the sleeve 12, which are in turn aligned with the threaded bores 32 of the guard. Similarly, smooth bores 44C of the barrel nut will self-align with the threaded apertures 35 of the sleeve. As will be apparent, threaded fasteners then can be inserted through the bores of the barrel nut to secure the inventive hand guard rail system to the firearm in a fully aligned position.

The simplified assembly process enabled by the present invention alleviates a known problem with prior hand guard rail systems, which is that it is difficult and time consuming to precisely align the top rail surface of a typical prior art hand guard with the top of a firearm receiver so that they are in registration. In such prior art systems, alignment is accomplished through trial and error by estimating an aligned position, securing a barrel nut to a firearm, and then assembling a hand guard to the firearm to assess alignment of the hand guard rail with the firearm receiver. If misaligned, the hand guard, the barrel nut, and possibly other components must be disassembled and realigned. The hand guard rail system 8, wherein alignment of the barrel nut bore 44A to the gas port of the firearm receiver 4 provides immediate visual indication that the hand guard 10 can be assembled in alignment with the receiver, renders prior art methods of trial and error assembly unnecessary.

When the hand guard rail system 8 is assembled with the receiver 4, as shown in FIG. 1, the arcuate rearward wings 37 of the sleeve 12 surround the barrel nut 14 and are substantially flush with the side rails 26 of the hand guard 10 and with side surfaces of the receiver. Given this configuration, the outer peripheral surfaces of the sleeve serve as a potential gripping point for a shooter's hand when the firearm is in use. Accordingly, the peripheral surfaces of the sleeve may be textured to provide additional grip for such a use, and/or may include circumferential grooves and ribs for enhanced convection cooling, as shown in FIG. 1.

Referring back to FIG. 4, while the side rails 26 are formed on the sidewalls 24, which are relatively thick in order to include the threaded bores 32 for accepting fasteners, the top and bottom rails 22 are formed on the top and bottom channels 18 and 20, resulting in relatively thin and light rails without significant reduction in strength when compared to known rail systems. In addition to standard cross cuts for indexed location of attachments, the outer surfaces of the Picatinny rails 22 and 26 include longitudinally extending grooves 58, further reducing the amount of material in the guard 10.

Also, as stated previously, the hand guard 10 does not include a threaded collar, but rather includes the recessed portion 30, which accepts the sleeve 12 in a slip-in fashion. Therefore, a thick outer collar is not needed to provide a strong threaded connection, and machining requirements have been reduced from a large-diameter thread concentric with a hand guard centerline to the plurality of small-diameter threaded bores 32 spaced around the hand guard centerline. Consequently, not only does manufacture of the disclosed hand guard require a lesser amount of base stock than was needed for prior art hand guards; additionally, the small-diameter threaded bores can be machined using less costly tools than would be required for a large-diameter concentric thread.

Moreover, by eliminating the prior art need for a radially thickened portion at the receiver end of the hand guard, it is possible for the hand guard 10 to have a uniform axial cross-section that may be extruded and cut to appropriate lengths. By contrast, in the prior art, each guard typically was separately milled from a discrete billet of stock. Because the uniform axial cross-section of the inventive hand guard permits extrusion rather than milling, the longitudinal grooves 58 formed along the rails 22 and 26 provide weight reduction without wastage of stock material. By contrast, weight reduction in prior art hand guards typically has been accomplished by removal of stock material, with associated expenses for machining and for scrap disposal.

Additionally, the hand guard 10 employs circumferential radius cuts 60 around the rails 22 and 26 for indexing attachments, instead of separate flat cross cuts on each rail as characteristic of many known hand guard rail systems. The radius cuts on the inventive hand guard can be made by a lathe using a single tooling setup, instead of by a milling machine using multiple setups as was typical in the prior art. As will be appreciated, use of a lathe, rather than a CNC milling machine, provides for a substantial (approximate fifty percent) decrease in manufacturing costs when compared to some known hand guard rail systems. The significant reductions in scrap production and disposal costs are expected to provide further benefits going forward. Thus, the uniform axial section geometry of the hand guard 10 provides an ease of manufacture and cost savings not presently known in the art, and also reduces the weight of the hand guard without compromising strength.

Referring to FIGS. 6 and 7, the hand guard rail system 8 may also include a pair of curved contact fingers 62 for engaging opposite sides of the firearm receiver to further reduce the potential for any rotational movement of the hand guard relative to the firearm receiver 4. The contact fingers could be secured to the hand guard 10 and to the firearm 2 via the sleeve 12 and the barrel nut 14. In particular, the fingers could be secured to the hand guard by inserting threaded fasteners, via holes 64 formed in the fingers and via selected smooth bores 44C of the barrel nut 14, into the threaded apertures 35 of the sleeve. The fingers are pre-formed with inward curves so that when secured to the firearm via the fasteners, the lower ends of the fingers contact the sides of the receiver 4 to prevent rotational movement of the barrel nut 14, the sleeve 12, and, ultimately, the hand guard 10 with reference to the receiver. The holes formed through the fingers preferably are round and closely fitted to the threaded fasteners as other shapes, e.g., slots and the like, would allow for undesired lateral displacement and rotation of each finger about its corresponding fasteners.

By contrast to the separate curved contact fingers 62, known systems sometimes employ a single, unitary C-shaped clamp to reduce gross rotational movement by friction. While the sliding contact of a clamp against a receiver may still permit fine rotational movements due to clearance and tolerance issues, use of separate contact fingers permits each finger to "wrap around" and firmly press against a side of a receiver, providing a positive stop to rotational movement.

In sum, the present invention provides a hand guard rail system that is easily aligned to a firearm receiver, and is resistant to rotational movement. Moreover, the present invention provides a strong, lightweight hand guard rail system that may be easily and inexpensively manufactured. Known hand guard rail systems do not provide this combination of benefits and features.

While the invention has been described with reference to the preferred embodiments, it will be understood by those skilled in the art that various obvious changes may be made, and equivalents may be substituted for elements thereof, without departing from the essential scope of the present invention.

Figure 9:
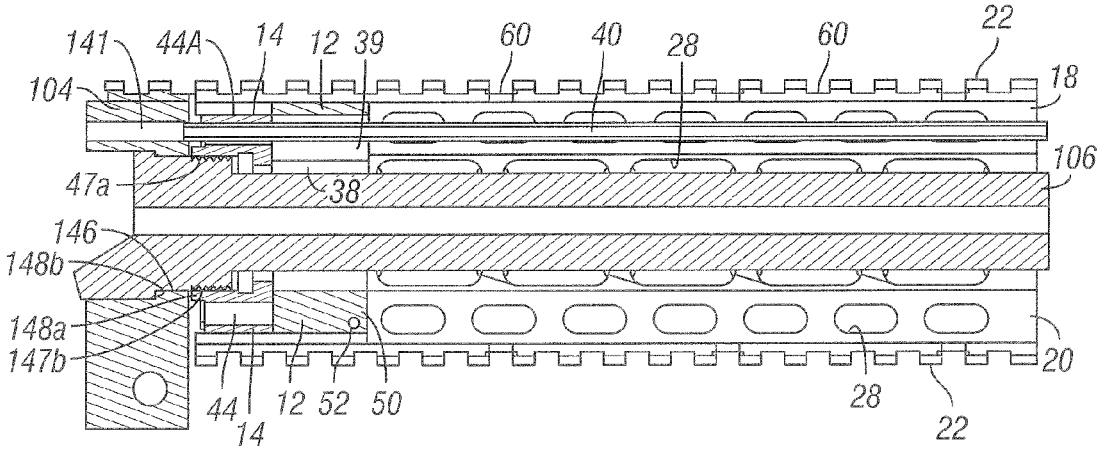
FIG. 9 shows a sectional partial side view of a firearm and a hand guard system, according to a second embodiment of the present invention.

For example, the invention may be adapted for use with a firearm receiver not having a gas port, wherein the barrel nut may be aligned with a center mark indicating a twelve o'clock position on the firearm receiver, possibly by aligning a flattened outer surface of the barrel nut to a corresponding flattened surface of the receiver. As another alternative, shown in FIG. 9, the hand guard rail system 8 may assembled to a rifle receiver 104 with a reduced-diameter barrel opening 146 by threading the internally-threaded surface 47*a* of the barrel nut 14 onto an externally-threaded enlarged-radius portion 147*b* formed on a barrel 106 until a rearward flat 148*a* formed on the barrel nut firmly contacts the receiver. Thereby, the barrel nut draws the barrel forward in the receiver and clamps a rearward flange 148*b* formed on the barrel against the reduced-diameter barrel opening of the receiver. Other alternative arrangements will be apparent in view of the disclosures made hereinabove and in the claims and drawings. Therefore, it is intended that the invention not be limited to the particular embodiments specifically described.

What is claimed is:

1. A firearm comprising:

a. a receiver with a barrel opening formed at a forward end of said receiver;

b. a barrel inserted into the barrel opening of said receiver;

c. a first attachment surface adjoining and coaxial with the barrel opening of said receiver;

d. a barrel nut with an outer surface, a second attachment surface defining a central axis of said barrel nut, and a plurality of bores extending axially through said barrel nut at radial positions between the outer surface and the second attachment surface, the second attachment surface being engaged with said first attachment surface such that said barrel nut secures said barrel into the barrel opening of said receiver;

e. a hand guard extending from a forward end to a rearward end between a peripheral surface and an inward surface, the inward surface being opened at the rearward and the forward ends to define a barrel space for receiving said barrel, said hand guard also including bores formed adjacent to the rearward opening of the barrel space;

f. a sleeve with an inner surface adapted to engage the outer surface of said barrel nut, an outward surface adapted to engage a portion of the inward surface of said hand guard, and a first plurality of openings for receiving fasteners inserted through the bores of said barrel nut, said sleeve being interposed between said barrel nut and said hand guard; and g. a plurality of fasteners, each fastener inserted into one of the bores of said barrel nut and passing through one of the openings of said sleeve and extending into one of the bores of the hand guard, to fasten the barrel nut, sleeve, and hand guard to one another.

2. A hand guard rail assembly for use with a firearm, said assembly comprising:

a. a hand guard with a peripheral surface and an inward surface extending between a rearward end and a forward end, the inward surface being opened at the rearward end and at the forward end to define a barrel space, and with bores formed adjacent to the rearward opening of the inward surface;

b. a barrel nut with an outer surface, an attachment surface for attaching said barrel nut to a firearm having a mating attachment surface, the attachment surface defining a central axis of said barrel nut, and a plurality of bores for receiving fasteners extending axially through said barrel nut between the attachment surface and the outer surface;

c. a sleeve formed with an inner surface adapted to engage the outer surface of said barrel nut, an outward surface adapted to engage a portion of the inward surface of said hand guard, and a plurality of openings for receiving fasteners extending through said sleeve between the inner surface and the outward surface; and d. a plurality of fasteners, each fastener inserted into one of the bores of said barrel nut and passing through one of the openings of said sleeve and extending into one of the bores of the hand guard, to fasten the barrel nut, sleeve, and hand guard to one another.

3. The firearm as claimed in claim 1, wherein the peripheral surface of said hand guard includes one or more protruding rails and the inward surface of said hand guard includes at least one outwardly recessed portion corresponding to one of the protruding rails formed on the peripheral surface.

4. The firearm as claimed in claim 3, wherein said hand guard includes cooling holes formed through at least one of the rails into the corresponding outwardly recessed portion of the barrel space.

5. The firearm as claimed in claim 3, wherein the rails have longitudinal grooves and radial cuts.

6. The assembly as claimed in claim 2, wherein said hand guard includes outwardly protruding top and bottom channels enclosing outward recesses of the barrel space, and further includes radially thickened portions extending between the top and bottom channels to define laterally opposing sidewalls, wherein rails are formed at the peripheral surface coextensive with the channels and the sidewalls.

7. The assembly as claimed in claim 6, wherein cooling holes are formed through at least one of the rails.

8. The assembly as claimed in claim 6, wherein the rails have longitudinal grooves and radial cuts.

9. The assembly as claimed in claim 6, wherein cooling holes are formed through at least one of the sidewalls.

10. The firearm as claimed in claim 1, wherein said first attachment surface is an external thread formed on said barrel.

11. The firearm as claimed in claim 1, wherein said first attachment surface is an internal thread formed in the barrel opening of said receiver.

12. The firearm as claimed in claim 1, wherein the plurality of openings formed in said sleeve extend through said sleeve substantially parallel to the outward surface of said sleeve.

13. The firearm as claimed in claim 1, wherein said plurality of fasteners include a first plurality of threaded fasteners inserted through selected smooth bores of said barrel nut, through corresponding openings of said sleeve, and into corresponding bores of said hand guard.

14. The firearm as claimed in claim 1, wherein said plurality of fasteners include a second plurality of fasteners inserted through selected openings of said sleeve and into corresponding bores of said hand guard.

15. The firearm as claimed in claim 1, wherein the plurality of openings formed in said sleeve include a first plurality of threaded openings, and said plurality of fasteners include a first plurality of threaded fasteners inserted through the bores of said barrel nut into the first plurality of threaded openings.

16. The firearm as claimed in claim 1, wherein said first attachment surface is an external thread formed on said receiver, the second attachment surface formed on said barrel nut is internally threaded, the plurality of openings formed in said sleeve include a first plurality of threaded openings and a second plurality of smooth openings, the bores of said hand guard are threaded, and said plurality of fasteners include first plurality of threaded fasteners inserted through selected bores of said barrel nut into the first plurality of threaded openings formed in said sleeve and a second plurality of threaded fasteners inserted through the second plurality of smooth openings formed in said sleeve into the threaded bores of said hand guard.

17. The assembly as claimed in claim 2, wherein said hand guard includes a protruding channel with a transverse hole extending through both side walls of the channel, said sleeve includes a forwardly protruding lug with a transverse opening, and said sleeve is fastened to said hand guard by a fastener inserted through the transverse hole of said hand guard and through the transverse opening of said sleeve.

* * * * *